US009211171B2

(12) United States Patent
Ehrsam et al.

(10) Patent No.: US 9,211,171 B2
(45) Date of Patent: Dec. 15, 2015

(54) METHOD FOR PACKING A PREDETERMINED LIQUID SUBSTANCE DOSE IN A STRAW AND DEVICE FOR CARRYING OUT SAID METHOD

(75) Inventors: Alain Ehrsam, Lyons (FR); Christian Beau, Voisins le Bretonneux (FR); Laurent Cohen, Riverdale, NY (US)

(73) Assignee: CRYO BIO SYSTEM, L'Aigle (FR)

( * ) Notice: Subject to any disclaimer, the term of this patent is extended or adjusted under 35 U.S.C. 154(b) by 1738 days.

(21) Appl. No.: 11/917,698

(22) PCT Filed: Jun. 13, 2006

(86) PCT No.: PCT/FR2006/001332

§ 371 (c)(1),
(2), (4) Date: Dec. 14, 2007

(87) PCT Pub. No.: WO2006/134265

PCT Pub. Date: Dec. 21, 2006

(65) Prior Publication Data

US 2008/0202628 A1 Aug. 28, 2008

(30) Foreign Application Priority Data

Jun. 14, 2005 (FR) ..... 05 06014

(51) Int. Cl.
*B65B 31/00* (2006.01)
*A61D 19/02* (2006.01)

(52) U.S. Cl.
CPC ..... *A61D 19/022* (2013.01)

(58) Field of Classification Search
CPC ..... B65B 43/42; B65B 1/04; A61D 19/022
USPC ..... 141/7, 59, 65; 422/521, 63; 436/54; 138/13, 39; 222/185.1; 435/1, 2
See application file for complete search history.

(56) References Cited

U.S. PATENT DOCUMENTS

| | | | | |
|---|---|---|---|---|
| 2,994,349 | A * | 8/1961 | Demos | 73/864.15 |
| 3,233,785 | A * | 2/1966 | Burke | 73/864.02 |
| 4,779,768 | A * | 10/1988 | St. Amand | 222/209 |
| 4,939,884 | A * | 7/1990 | Peters | 53/127 |
| 5,067,532 | A * | 11/1991 | Lang et al. | 141/329 |
| 5,283,170 | A * | 2/1994 | Cassou et al. | 435/1.3 |
| 5,402,915 | A * | 4/1995 | Hogan | 222/105 |

(Continued)

FOREIGN PATENT DOCUMENTS

| | | | |
|---|---|---|---|
| EP | 0480109 | A | 4/1992 |
| EP | 085629 | A1 | 8/1998 |
| FR | 2810535 | A | 12/2001 |

*Primary Examiner* — Len Tran
*Assistant Examiner* — Joel Zhou
(74) *Attorney, Agent, or Firm* — Browdy and Neimark, PLLC

(57) ABSTRACT

The inventive device is provided with a unit (1) comprising a body (3) which interacts with a pipette tip (24) in a vertical position in order to retain the content of the pipette tip (24) in the unit (1) and comprises a nozzle (2) having a capillary channel (4) insertable into a straw (25) oriented in a transversal position with respect to the body in such a way that, when the body is in a vertical position, said nozzle (2) is in a horizontal position. The inventive method consists in sampling a liquid substance initially contained in a top-open container (45) with the aid of the pipette tip (24) in the vertical position, in transferring the content of pipette tip (24) to the body (3) of the unit (1) prior to filling the straw (25) with the predetermined dose of a liquid substance transferred thereto from the unit (1).

43 Claims, 7 Drawing Sheets

(56) References Cited

U.S. PATENT DOCUMENTS 5,544,535 A * 8/1996 Thomas ..... 73/864.22
5,673,823 A * 10/1997 Hanks et al. ..... 222/185.1
5,868,178 A * 2/1999 Lecointe ..... 141/110
6,126,632 A * 10/2000 Verbovszky et al. ..... 604/78
2006/0127281 A1* 6/2006 Bjornson et al. ..... 422/100

* cited by examiner

METHOD FOR PACKING A PREDETERMINED LIQUID SUBSTANCE DOSE IN A STRAW AND DEVICE FOR CARRYING OUT SAID METHOD

The present invention concerns the packing of predetermined doses of a liquid substance in straws.

It is known that straws are packaging units formed of a thin plastic material tube the inside diameter of which is in particular sufficiently small for the liquid substance dose to be held in place by capillary action and a stopper engaged in the thin tube near one end, including two porous plugs, and between those two plugs, a volume of gel powder, i.e. powder that is converted into a gel in contact with an aqueous liquid.

There is already known, in particular from the European patent application 0 480 109, a packing method including a filling step for causing a predetermined dose of a liquid substance, initially contained in a receptacle open at the top, to penetrate into the thin tube of a straw. This step is carried out by nesting a filling accessory in a sealed manner in a first end of the thin tube of the straw while the second end of this thin tube is connected to a vacuum source, with the straw lying down, and with a conduit of the filling accessory immersed in the liquid substance contained in the receptacle. The reduced pressure generated in the straw by the vacuum source causes the liquid substance to flow from the receptacle to the straw, via the filling accessory. European patent application 0 856 298 describes an improved version of the filling accessory.

A machine exists for carrying out this method in which the accessory and the receptacle are mounted manually on an accessory-carrier and a receptacle-carrier, respectively, of a mobile carriage performing to-and-fro movements coordinated with the transverse displacement of a belt conveying the straws to be filled so as to engage the filling accessory in a straw from the belt and then extract it therefrom, then in the next straw, and so on with the successive straws.

If the liquid substance to be packed must be changed or when the receptacle placed in the accessory-carrier is empty:

- the filling accessory must be removed from the accessory-carrier;
- the receptacle must be removed from the receptacle-carrier;
- another receptacle must be placed in the receptacle-carrier;
- a new filling accessory must be mounted on the accessory-carrier; and
- the conduit of this new accessory must be immersed in the liquid substance contained in the receptacle.

The invention aims to automate further the filling of straws in a simple, convenient and economical manner.

To this end it proposes a method for packing in a straw a predetermined dose of a liquid substance initially contained in a receptacle open at the top, including a filling step for causing said predetermined dose to penetrate into said straw, which is lying down, with a filling accessory nested in said straw, which method is characterized in that it includes, before the filling step:

- the step of causing an upright pipette tip to cooperate with said receptacle to take up therefrom at least one dose of liquid substance;
- the step of procuring one of said accessories having a body adapted to cooperate with said upright pipette tip and having a spout with a capillary passage adapted to be nested in said straw, which spout is oriented transversely to said body so that when said body is upright said spout is lying down; and

- the step of causing said upright pipette tip containing at least said dose to cooperate with said body so that the content of said pipette tip belongs to this accessory.

It then suffices to nest the spout in the straw and to carry out the filling step in the standard way.

Because the passage in the spout is a capillary tube, the content of the accessory, coming from the pipette tip, can remain in the accessory until the vacuum source generates the reduced pressure in the straw causing the liquid substance to flow.

Thanks to the accessory that the method according to the invention uses, it is possible to employ a standard automaton with pipette tips to take up liquid in the receptacle open at the top.

Replacing the manual operation of immersing the conduit of the accessory in the receptacle initially containing the liquid substance to be packed with an automatic operation employing a pipette tip has the advantage of greater safety, in particular from the sanitary point of view.

As will emerge hereinafter, it is advantageously possible, in particular thanks to the preferred features disclosed hereinafter, to use the automaton with pipette tips to manipulate not only the pipette tips but also the filler accessories.

According to features that are preferred for reasons of simplicity and convenience as much of fabrication as of use:

- the method further includes, before the filling step:
  - the step of placing the accessory in an accessory-carrier belonging to a mobile carriage when the latter is in a retracted position; and
  - the step of moving the carriage from said retracted position to a working position to nest said accessory in sealed manner in said straw;
- the method includes before the step of causing said pipette tip to cooperate with said receptacle:
  - the step of nesting said pipette tip in a pipette;
  - while the step of causing said pipette tip to cooperate with said receptacle includes:
  - the step of disposing said pipette fitted with said pipette tip over said receptacle;
  - the step of immersing the end of said pipette tip in said liquid substance contained in said receptacle; and
  - the step of creating a reduced pressure in said pipette tip to aspirate said liquid substance;
- the step of causing said pipette tip containing at least said dose to cooperate with said accessory includes:
  - the step of disposing said pipette tip containing at least said dose over said accessory; and
  - the step of eliminating the reduced pressure in said pipette tip to release the content of said pipette tip;
- the following steps are executed automatically:
  - the step of causing said pipette tip, in the upright position, to cooperate with said receptacle to take up therefrom said dose of liquid substance; and
  - the step of causing said pipette tip, in the upright position, containing at least said dose to cooperate with said accessory so that the content of said pipette tip belongs to that accessory.
- the method includes, before said steps executed automatically:
  - the manual step of placing an accessory box including said accessory;
  - the manual step of placing a receptacle-carrier containing said receptacle; and
  - the manual step of placing a tip-carrier containing said pipette tip;
- an accessory rack is selected as the accessory box;
- a pipette tip rack is selected as the tip-carrier;

a receptacle rack is selected as the receptacle-carrier;

a receptacle carousel is selected as the receptacle-carrier; and/or the method includes, before the filling step:

the step of moving said accessory from said accessory box to a position over an accessory carrier;

the step of engaging said accessory in said accessory-carrier from above to deposit it; and the step of causing said accessory to slide horizontally relative to said accessory-carrier from a position deposited on said accessory-carrier to a position abutted against said accessory-carrier.

Note that the above features can be used independently of the features previously disclosed.

Preferably:

the step of moving said accessory includes:

the step of procuring a clamp;

the step of said clamp grasping said accessory in said accessory box; and the step of disposing said clamp grasping said accessory over said accessory-carrier; and/or the step of sliding said accessory includes the step of moving a plunger pressed against said accessory.

A second aspect of the invention provides a device for implementing the above method, including an accessory adapted to be nested in a straw when it is lying down to introduce into it a predetermined dose of liquid substance initially contained in a receptacle open at the top, characterized in that said accessory has a body adapted to cooperate with an upright pipette tip so that the content of said pipette tip belongs to that accessory, and has a spout with a capillary passage adapted to be nested in said straw, oriented transversely to said body so that when said body is upright said spout is lying down.

According to features that are preferred, for reasons of simplicity and convenience as much of fabrication as of use:

said body includes a bottom wall;

said bottom wall is inclined relative to said spout at an angle between 25° and 35°;

said bottom wall is inclined relative to said spout at an angle between 2.5° and 6.5°;

said spout includes said capillary passage throughout its length;

said body includes a bottom wall and said capillary passage extends from an outlet orifice to a passage that communicates with a space delimited by said body and said bottom wall;

the bottom part of said passage is flush with the lowest part of said bottom wall of said body;

said spout includes a cylindrical portion and a frustoconical portion;

said spout includes a cylindrical portion and a frustoconical portion attached to said cylindrical portion;

said body includes a bottom wall and a tubular wall divided into a first tubular portion and a second tubular portion by said bottom wall;

said first portion and said bottom wall delimit a reservoir for containing said liquid substance while said second tubular portion forms a base on which said accessory bears;

said body includes a bottom wall and a frustoconical wall extending from an entry opening as far as said bottom wall;

said accessory has a rib opposite said spout;

said accessory has two tongues opposite each other on said body;

said accessory includes two lugs one on each side of each of said tongues;

said accessory includes two notches flanking an entry opening above said tongues;

said device includes, in addition to the accessory, a clamp having a central body and two elastically deformable arms connected to said central body including in their distal part a hook adapted to be engaged with or disengaged from said respective tongue of said accessory by elastic deformation of said arms;

said arms include a section disposed between said central body and said hook;

said hook has a convex surface against which said tongue bears to load said arms elastically;

said accessory includes two notches flanking an entry opening and each arm has, at the junction between said section and said hook, a shoulder adapted to be housed in said respective notch of said accessory when said hooks are engaged in said tongues;

said device includes, in addition to the accessory, an accessory-carrier including a base on which said accessory bears when it rests on said accessory-carrier and lugs against which said accessory abuts when said accessory is in abutment position, said spout projecting beyond said lugs;

said lugs have a circular-arc-shaped depression against which said accessory abuts in said abutment position;

said lugs are separated by a frustoconical profile groove in which said accessory is accommodated;

said accessory has two tongues opposite each other on said body and two lugs one on each side of each of said tongues and said lugs of said accessory-carrier have on the side opposite said frustoconical groove a projecting rim under which one of said lugs of said accessory locates when said accessory is in said abutment position;

said device includes, in addition to the accessory, a plunger including a presser member and an actuator including a rod and a body, said presser member being adapted to bear against said accessory so that the accessory slides from a first position to a second position;

said presser member has a circular-arc-shaped depression adapted to come into contact with said accessory;

said accessory has a rib opposite said spout and said presser member and said rib are arranged so that said rib locates under the lower surface of said presser member when said presser member comes into contact with said accessory; and/or said accessory has a spout with a capillary passage formed in a single rigid block adapted to be nested in said straw.

Note that the above features can be used independently of the features previously disclosed.

Preferably:

said spout includes a frustoconical portion and a cylindrical portion;

said spout includes a capillary passage; and/or said spout is molded in one piece from rigid plastic material.

The features and advantages of the invention will emerge from the following description, given by way of preferred, but nonlimiting, example, with reference to the appended drawings, in which.

Figure 1:
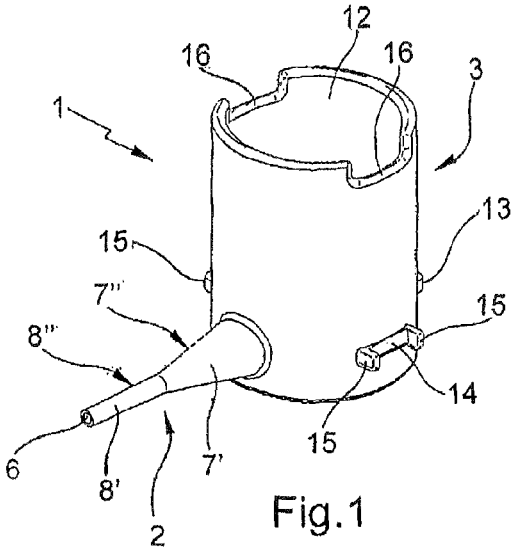
FIGS. 1 and 2 are two perspective views at two different angles showing in isolation a filling accessory conforming to the invention.
Figure 2:
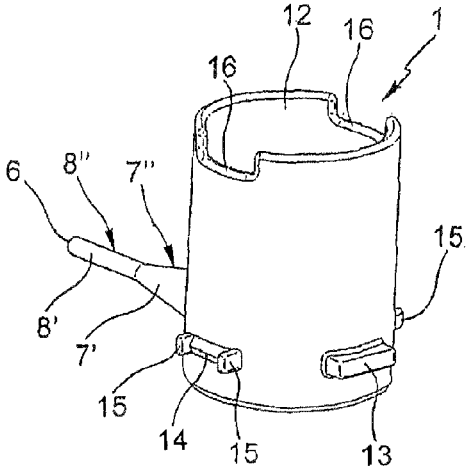
Figure 3:
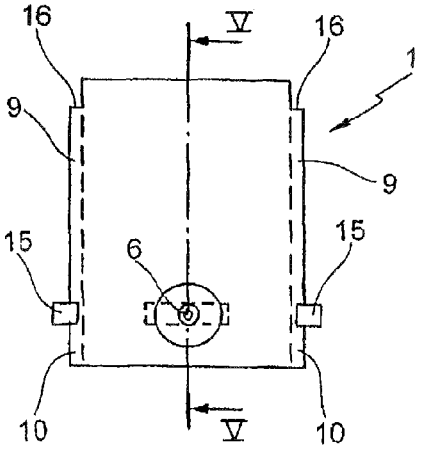
FIGS. 3, 4 and 5 show that accessory respectively in an elevation view from the side seen on the left in FIG. 1, a plan view from above, and an elevation view in section taken along the line V-V in FIG. 3.
Figure 4:
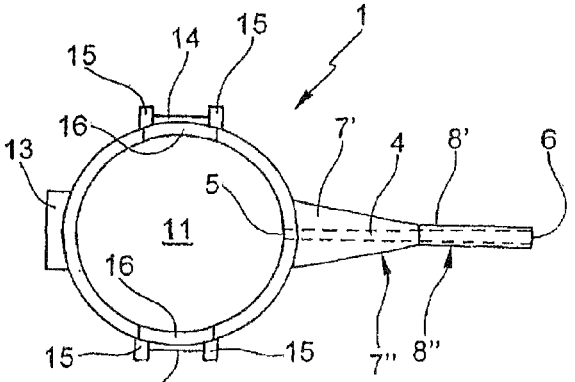
Figure 5:
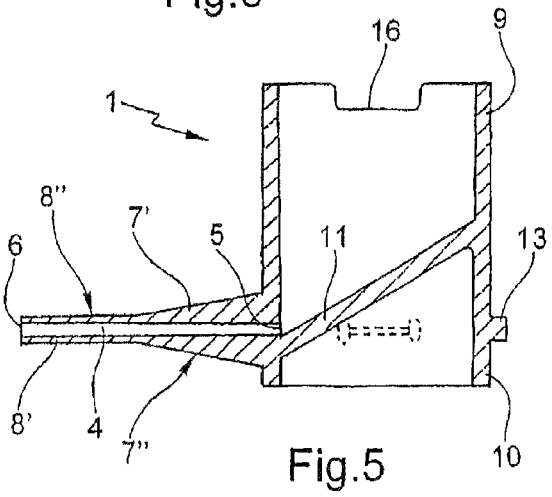

The accessory 1 shown in FIGS. 1 to 5 includes a spout 2 and a body 3. The spout 2 is in one piece with the body 3 and projects transversely to the body.

The spout 2 is formed of a single part molded from rigid plastic material and includes a capillary passage 4 here extending the entire length of the spout 2 between a first end having a passage 5 through which the passage 4 communicates with the space delimited by the body 3 and a second end having an outlet orifice 6.

A first portion 7' of the spout 2 having a frustoconical exterior surface 7" extends from the body 3 to half the length of the spout 2 with a decreasing section and is extended by a second portion 8' of the spout having a cylindrical exterior surface 8" extending from the first portion 7' as far as the distal end of the spout 2.

The cylindrical portion 8' has a taper of about 0.5°.

The body 3 includes a tubular wall divided into two portions 9 and 10 by a bottom wall 11. The portion 9 delimits with the wall 11 a reservoir for containing a liquid substance. That reservoir has an entry opening 12 at the end opposite the bottom wall 11. The portion 10 forms a base on which the accessory rests.

Here the bottom wall 11 is inclined at an angle of 30° relative to the spout 2.

The capillary passage 4 communicates with the body 3 through the passage 5 the lower portion whereof has an opening level with the lowest portion of the bottom wall 11 of the body 3, i.e. at the lowest level of the reservoir.

The body 3 is generally oriented in a direction transverse to the general orientation of the spout 2, the accessory 1 therefore having an elbow-like general shape.

Opposite the spout 2, the body 3 includes, on its external face, a rigid rib 13 in one piece with the block 3 and of parallelepipedal general shape.

Two diametrically opposed tongues 14 in one piece with the body 3 are disposed on the external face of the body 3, at the same level and half way between the rib 13 and the spout 2. Two lugs 15 are situated one on each side of each tongue 14.

A notch 16 vertically aligned with each tongue 14 is formed at the end of the body 3 flanking the opening 12.

Figure 6:
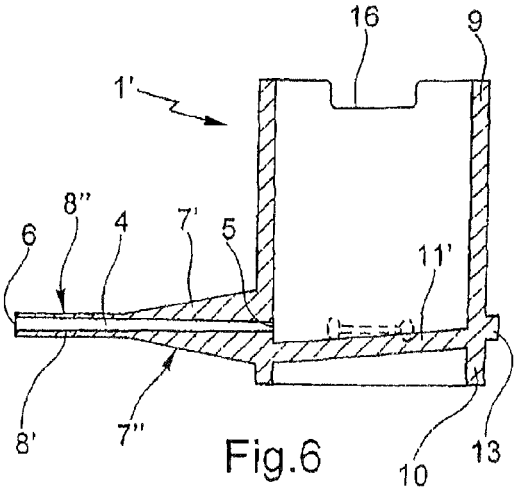
FIG. 6 is a view similar to FIG. 5 showing a variant of this accessory in which the bottom wall has a shallow inclination.
Figure 7:
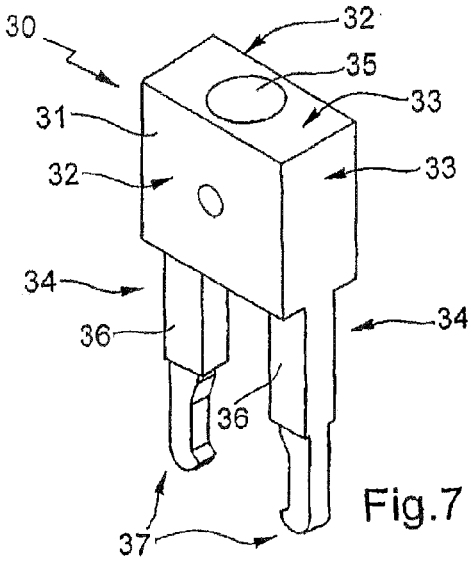
FIGS. 7 and 8 are respectively a perspective view and an elevation view of a clamp for grasping the accessory.
Figure 8:
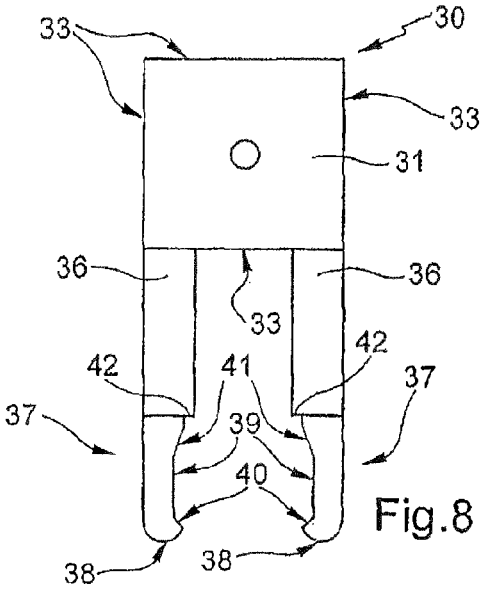
Figure 9:
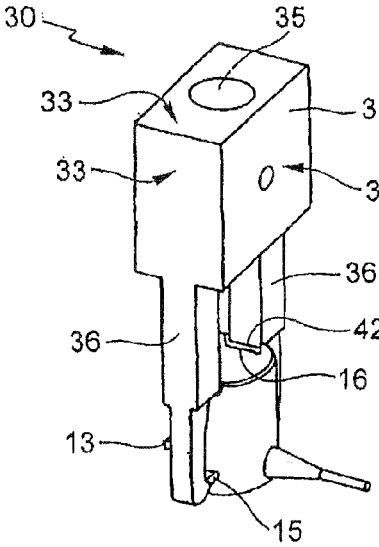
FIG. 9 is a perspective view of this clamp and an accessory that it is grasping.
Figure 10:
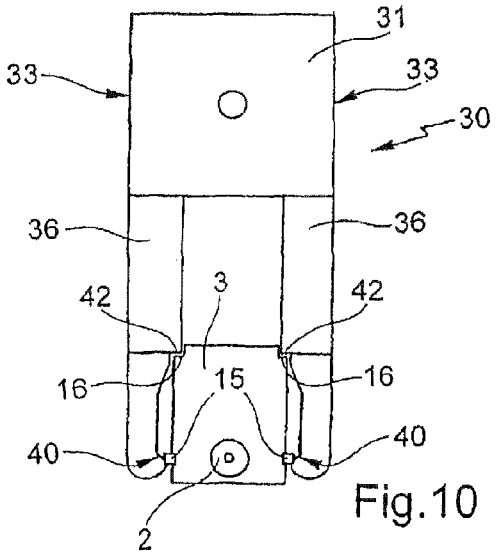
FIGS. 10, 11 and 12 show this clamp-accessory assembly respectively in an elevation view from the side seen on the right in FIG. 9, an elevation view from the side seen on the left therein, and a plan view from above.
Figure 11:
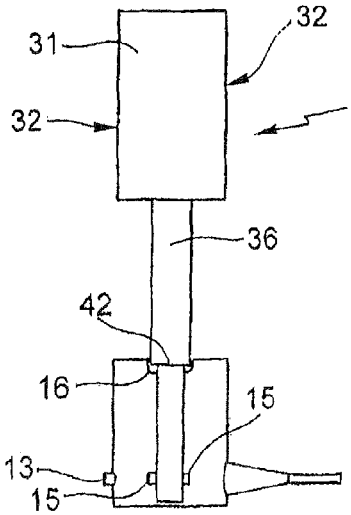
Figure 12:
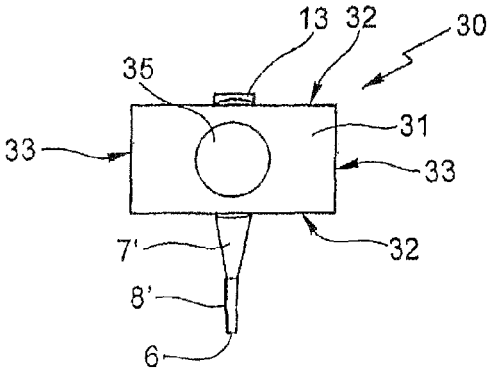

The variant 1' of the accessory shown in FIG. 6 is described next. The same references are used for identical elements as are used for the accessory 1.

The accessory 1' is identical to the accessory 1 except that the bottom wall 11 of the body 3 is less steeply inclined relative to the spout 2, here at 4.5°.

A clamp enabling the accessory to be manipulated by a robot arm such as the arm 95 (FIGS. 18 to 21) is described next with the aid of FIGS. 7 to 12.

The clamp 30 for grasping the accessory 1 includes a central body 31 and two elastically deformable arms 34.

The central body 31 has a parallelepipedal general shape including two square faces 32 and four similar rectangular faces 33 extending from one to the other of each side of the square faces. One of the rectangular faces 33 has at its center an orifice 35 for connection to a robot arm.

The two arms 34 are connected transversely to the rectangular face 33 opposite that including the orifice 35.

Each arm 34 has a section 36 of parallelepipedal shape and a hook 37 aligned with the section 36 and facing the hook 37 of the other arm.

Each hook 37 has a convex surface 38 and a straight surface 39 set back relative to the section 36, a straight surface 40 connecting the convex surface 38 to the set back surface 39, and a surface 41 connecting the set back surface 39 to the section 36.

The junction of the convex surface 38 and the straight surface 40 points towards the other hook 37 while the junction between the straight surface 40 and the set back surface 39 points toward the hook 37 of which it is part.

The junction of the set back surface 39 with the surface 41 points toward the hook 37 of which it is part while the junction of that surface 41 with the section 36 forms a shoulder 42.

The accessory-carrier 60 on which the accessory rests during the filling step is described next with the aid of FIGS. 13 to 17.

The accessory-carrier 60 includes a base 61 of parallelepipedal general shape and two lugs 62 projecting from the base 61.

The base 61 has two rectangular main faces 63, two rectangular faces 64 extending from one to the other of the longer sides of the main faces 63 and two rectangular faces 65 extending from one to the other of the shorter sides of the main faces 63.

One of the faces 64 rests on a plate 70 belonging to a mobile carriage none of the rest of which is shown.

The lugs 62 are joined to the other face 64 of the base 61, projecting the latter, in alignment with a corner between a face 63 and a face 65. The lugs 62 are separated from each other by a frustoconical profile groove 66 the section of which increases from the face 65 nearer the groove 66 to the face 65 farther from it.

Each lug 62 has a section of triangular general shape and has on its face adjacent to the groove 66 where the section is widest a circular-arc-shaped depression 67 the radius of curvature of which is identical to the radius of curvature of the body 3 and a projecting rim 68 aligned with the recess 67 on the side opposite the groove 66.

The plunger 50 for sliding the accessory 1 from the position where it is deposited by the clamp 30 on the accessory-carrier 60 to its position abutted against the accessory-carrier 60 is described next with the aid of FIG. 13 and FIGS. 15 to 17.

The plunger 50 includes a presser member 53 and an actuator formed of a rod 51 and a body 52.

The rod 51 is connected at one end to the presser member 53 and at the other end to a piston (not visible in the drawings) mobile inside the body 52.

Here the presser member 53 is of parallelepipedal general shape. The rectangular face opposite the face connected to the rod 51 has a circular-arc-shaped depression 54 the radius of curvature of which is identical to the radius of curvature of the body 3.

Ancillary devices for carrying out the automatic straw filling cycle, in particular a clamp-carrier 80 used to stow the clamp 30 when it is not connected to the robot arm, and means for disengaging the accessory 1 from the clamp 30, are described next.

Figure 18:
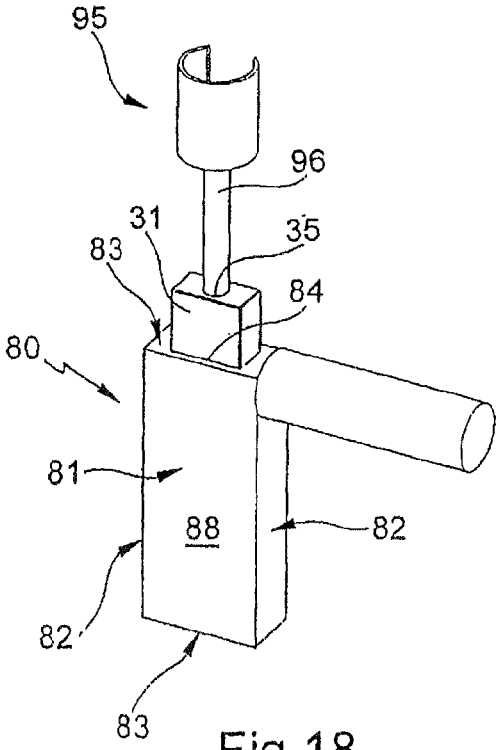
FIGS. 18 and 19 are respectively a perspective view and an elevation view of the clamp engaged in a clamp-carrier.
Figure 19:
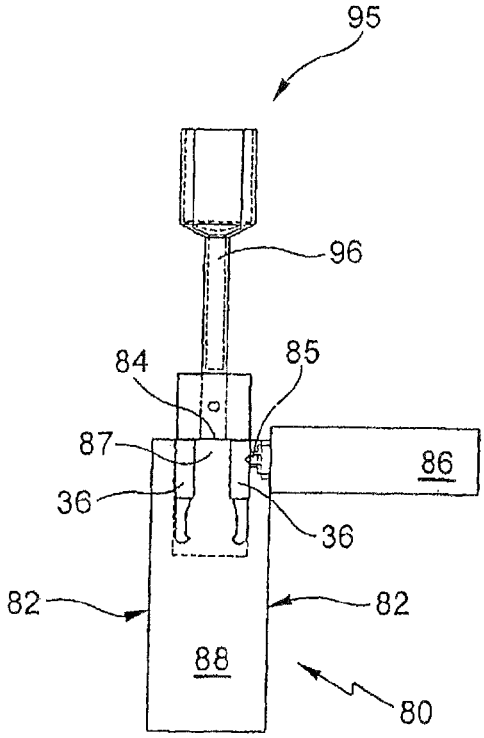

The clamp-carrier 80 shown in FIGS. 18 and 19 includes a base 88 of parallelepipedal general shape having two main faces 81 and, extending from one to the other of the longer sides of the main faces, two similar rectangular faces 82, and from one to the other of the shorter sides of the main faces, two similar rectangular faces 83. The base 88 includes a cavity 87 opening onto one of the faces 83 via an opening 84. A lug 85 driven by a motor 86 is housed in the cavity 87.

Figure 20:
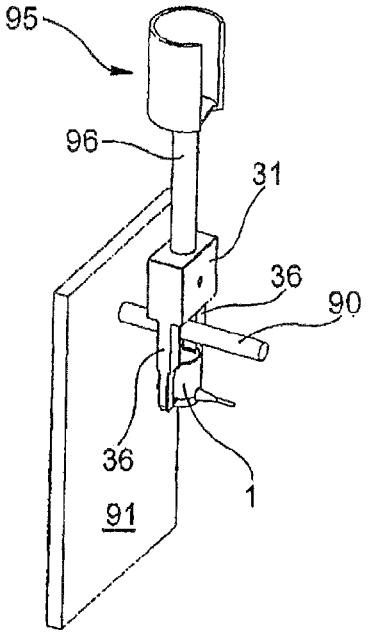
FIGS. 20 and 21 are respectively a perspective view and an elevation view from the side seen on the right in FIG. 20 of a device for disengaging the accessory from the clamp.
Figure 21:
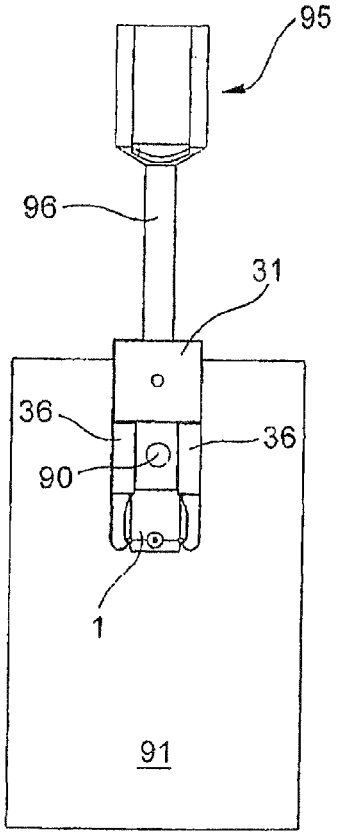

The accessory disengagement device shown in FIGS. 20 and 21 includes a rod 90 connected transversely to a fixed vertical wall 91.

The robot arm 95, shown in FIGS. 18 to 21, includes a pipette rod 96 the distal end of which can equally well, as will emerge hereinafter, be engaged in the orifice 35 of the clamp 30 or in a pipette tip 24. The arm 95 includes pneumatic means for producing a pressure reduction in a pipette tip to aspirate a liquid substance and for eliminating the reduced pressure in the pipette tip to release the liquid contained in the pipette tip.

The manual steps to be carried out before proceeding to the automatic filling of straws are described next.

The receptacles open at the top containing the liquid substances to be packed are here glass primary tubes 45 (of the test tube kind), disposed beforehand in a receptacle-carrier 46 (FIGS. 22 and 23) such as a carrousel or a primary tube rack. This receptacle-carrier, separate from the accessory-carrier 60 preinstalled in the machine, is loaded manually in the machine before starting a cycle.

The same applies to the tip-carrier (here a pipette tip rack that is not shown) and the accessory box (here an accessory rack that is not shown), which are also loaded manually.

Empty straws 25 are also disposed manually in a straw dispensing cavity not shown in the figures.

An aspiration nozzle 27, which does not need to be replaced afterwards because it does not come into contact with the liquid to be packed, is fixed manually to a mobile carriage and connected to a vacuum pump type vacuum source 29, as shown in FIGS. 22 to 26.

The various steps carried out automatically for packing liquid substances in straws are described next.

The robot arm 95, which can be manipulated in the three spatial dimensions, is placed above the clamp-carrier 80. The robot arm 95 is lowered in the direction of the clamp-carrier 80, the male tip of the pipette rod 96 of the arm 95 engages in the orifice 35 of the clamp 30, as shown in FIGS. 18 and 19. The motor 86 is then driven to retract the lug 85.

The robot arm 95 equipped with the clamp 30 is then moved over the accessory rack (not shown).

To grasp an accessory as shown in FIGS. 9 to 12, the arm 95 and the clamp 30 are placed above the accessory and lowered. The arms 34 of the clamp 30 move along the external face of the body 3 until the convex surface 38 bears against the tongues 14. The convex surface 38 at the free end of the hooks 37 tends to move the sections 36 apart until each tongue 14 engages in a hook 37. Their resilience causes the arms 34 of the clamp 30 to close around the tongues 14 and the shoulders 42 of the arms 34 locate in the notches 16 of the body 3 provided for this purpose.

The lugs 15 at either end of each tongue 14 and the notches 16 prevent any movement in rotation of the body 3 around the clamp 30, ensuring that each tongue 14 is held in position in the respective hook 37.

Figure 13:
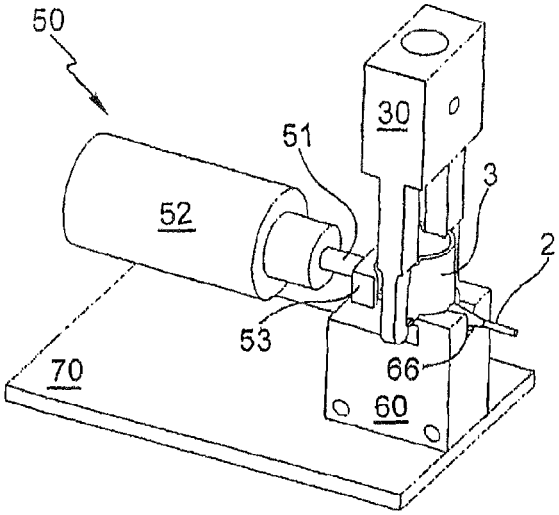
FIG. 13 is a perspective view showing the clamp, an accessory-carrier, a plunger and the accessory placed on the accessory-carrier.
Figure 14:
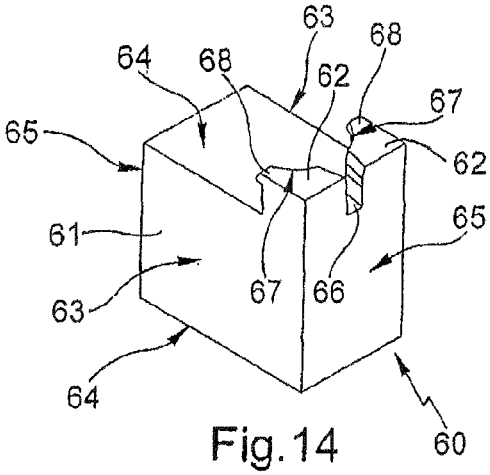
FIG. 14 is a perspective view showing the accessory-carrier in isolation.
Figure 15:
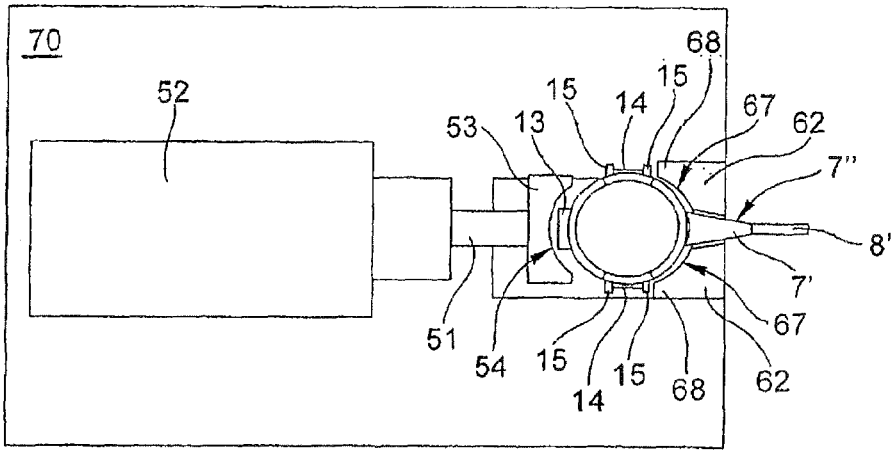
FIG. 15 is a plan view from above of the accessory, the accessory-carrier and the plunger as seen in FIG. 13 but in which the clamp, although present, is not shown to clarify the drawing.

The grasped accessory is moved from the accessory rack (not shown) until it is above the accessory-carrier 60 and is then engaged from above in the accessory-carrier 60 to be deposited as shown in FIG. 13 on the bearing surface 64 of the base 61 of the accessory-carrier 60. The robot arm 95 orients the spout 2 so that it engages in the frustoconical groove 66.

Figure 16:
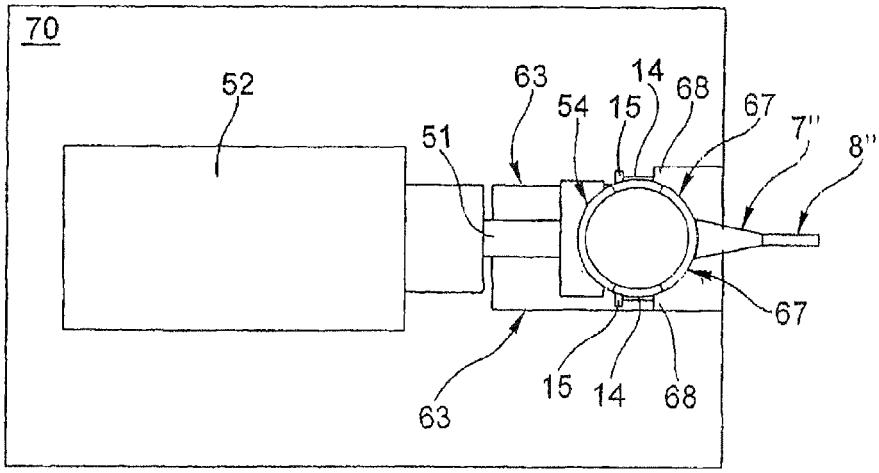
FIG. 16 is a view similar to FIG. 15 but in which the accessory is pressed by the plunger against the accessory-carrier in its abutment position.
Figure 17:
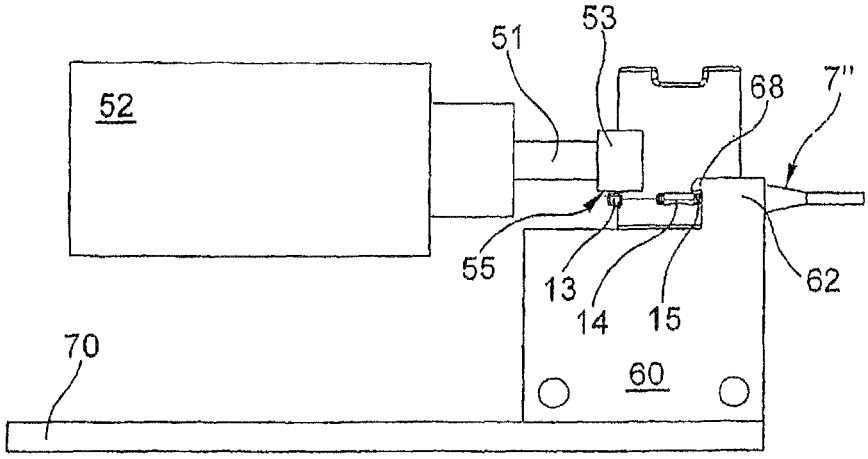
FIG. 17 is a view in elevation from the side seen at the bottom in FIG. 16.

The presser member 53 is then moved into contact with the accessory in order for the circular-arc-shaped depression 54 on the presser member 53 to come to bear against the portion 9 of the accessory 1 on the side opposite the spout 2, and the accessory therefore slides horizontally on the accessory-carrier 60 from its deposited position (shown in FIGS. 13 and 15) to a position abutted against the lugs 62 of the accessory-carrier 60, shown in FIGS. 16 and 17.

In this abutment position, the rib 13 of the accessory 1 is situated under the lower surface 55 of the presser member 53.

Figures 22, 23, 24:
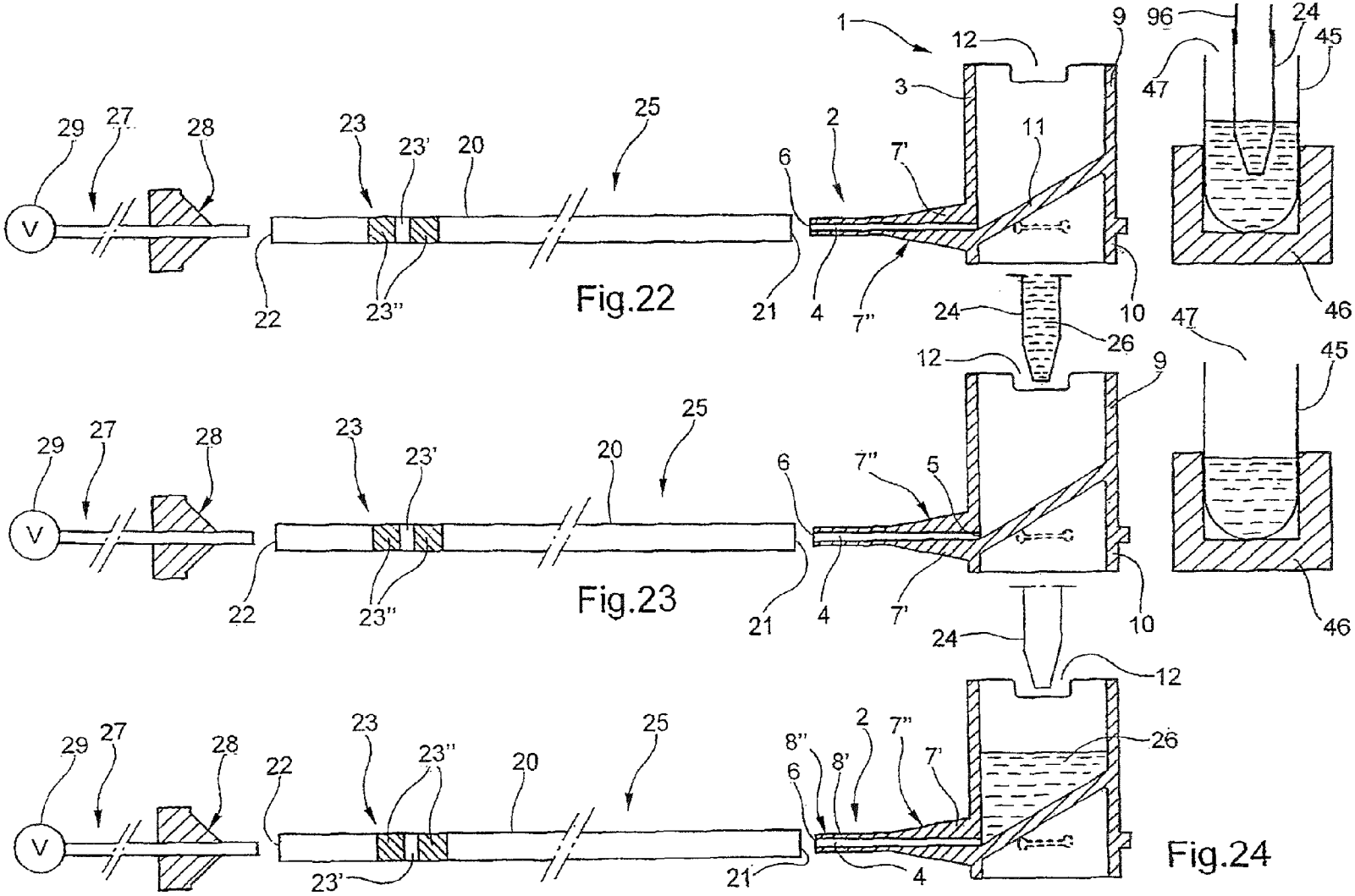
FIG. 22 is a diagrammatic view showing how a straw, a filling accessory, an aspiration nozzle, a pipette tip and a receptacle disposed in a receptacle-carrier in a position in which the pipette tip cooperates with the receptacle containing a liquid substance cooperate in accordance with the invention.
FIG. 23 is a view similar to FIG. 22 but in a position in which the pipette tip is disposed above the entry opening of the accessory, after having taken up from the receptacle a certain quantity of liquid substance.
FIG. 24 is a view similar to FIG. 22 but in a position in which the content of the pipette tip has been transferred to the accessory.

During the movement of the accessory 1, the frustoconical portion 7' of the spout 2 of the accessory-carrier 60 is guided by the frustoconical groove 66, thanks to which the outlet orifice 6 is disposed precisely opposite and at the center of the end 21 of the thin tube 20 of a straw 25, as shown in FIG. 22.

The straw 25 for its part has been fed by a conveyor belt (not shown) to the position shown, in which it must be filled.

The base portion 10 orients the capillary passage 4 along the axis of the straw 25 independently of the inclination of the bottom wall 11, and so, in the position abutted on the accessory-carrier 60, the capillary passage 4 is parallel to and centered relative to the straw 25. The body 3 is then upright, whereas the spout 2, oriented transversely to the body 3, is lying down, like the straw 25.

In the abutment position (FIGS. 16 and 17), the spout 2 projects beyond the lugs 62 of the accessory-carrier 60 while each lug 15 of the accessory 1 nearest the spout 2 locates under the rim 68 of the corresponding lug 62 of the accessory-carrier 60.

If the accessory is pulled up in the abutment position, each lug 15 of the body 3 nearest the spout 2 abuts against the respective projecting rim 68 of the lug 62 of the accessory-carrier 60 while the rib 13 of the body 3 abuts against the lower surface 55 of the presser member 53.

The robot arm 95 can therefore be raised to disengage the tongues 14 of the accessory 1 elastically from the hooks 37 of the clamp 30, in the opposite of the engagement operation described hereinabove, the inclination of the straight surface 40 of the hook 37 relative to the tongue 14 facilitating unhooking.

The robot arm 95 then replaces the clamp 30 in the clamp-carrier 80.

The motor 86 is then driven so that the lug 85 bears on one of the sections 36 of the clamp 30 in order to hold it in position when the arm is raised to disconnect it from the clamp 30.

The arm 95 is then placed above the pipette tip rack (not shown) in order to plug the male end of the pipette rod 96 of the robot arm 95 into a pipette tip 24 (FIGS. 22 and 23).

The robot arm 95 carrying the upright pipette tip 24 is then placed over one of the receptacles 45 open at the top containing the liquid substance to be packed in order to cause the pipette tip 24 to cooperate with the receptacle 45 via its opening 47: the distal end of the upright pipette tip 24 is immersed in the liquid substance as shown in FIG. 22.

Figure 26:
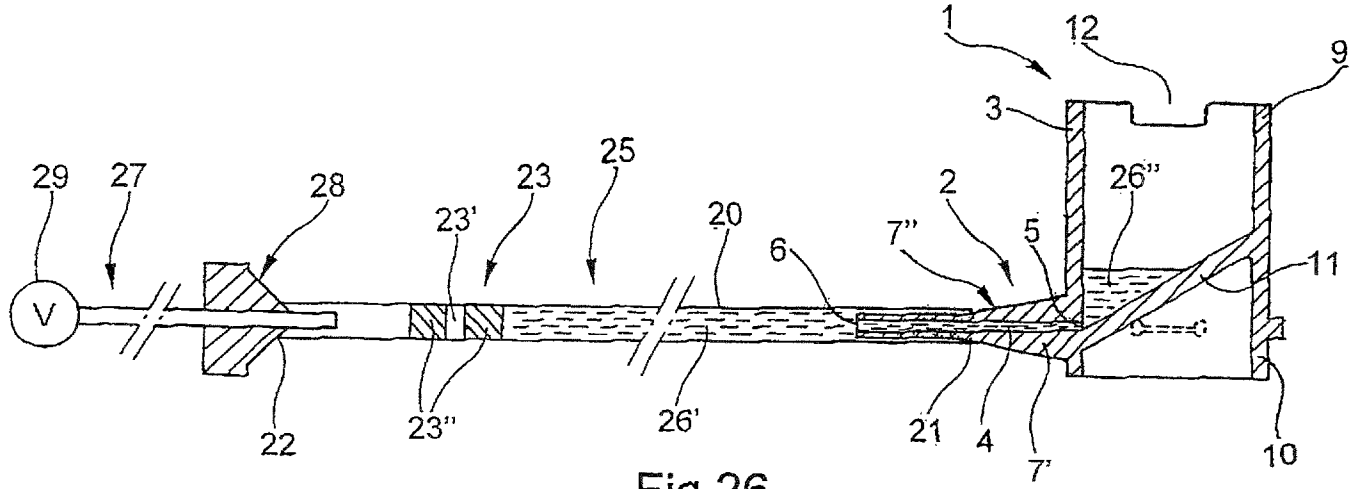
FIG. 26 is a view similar to FIG. 22 but in a position in which a predetermined dose of liquid substance has been introduced into the tube of the straw.

A reduced pressure is then generated in the pipette tip 24 so that it can aspirate a quantity 26 of liquid substance (FIG. 23) containing at least a predetermined dose 26' of liquid substance (FIG. 26).

The arm 95 carrying the pipette tip 24 filled with the quantity of liquid 26 that it contains is then placed over the body 3 of the accessory 1, as shown in FIG. 23, still in the position abutted against the accessory-carrier 60.

The reduced pressure in the pipette tip 24, which is still upright, is then eliminated so that the quantity of liquid 26 is released from the pipette tip 24 and collected in the body 3 of the accessory 1 as shown in FIG. 24.

The distal end of the pipette tip 24 is placed over the opening 12 here, but it is equally possible to place it under it, at the top of the reservoir of the accessory 1.

As explained later with the aid of FIGS. 27 and 28, other modes of cooperation between a pipette tip 24 and a filling accessory for causing the liquid substance to pass from the pipette tip 24 into a filling accessory are possible.

In the accessory 1, the capillary passage 4 of the spout 2 and the body 3 have dimensions such that when the body 3 of the accessory is filled, as shown in FIG. 24, and maintained at atmospheric pressure, the passage 4 opposes flow of the liquid substance by capillary action in the absence of a reduced pressure, given the viscosity of that substance. The liquid therefore does not flow through the capillary passage 4 unless the outlet orifice 6 is subjected to a reduced pressure.

The straw 25 shown in FIGS. 22 to 26 is disposed on a conveyor belt, not shown, and more precisely in a group of calibrated notches in which it was engaged automatically from a hopper, the belt having a regular succession of groups of notches, the straws placed on the belt being perpendicular to its direction of forward movement.

During the operation shown in FIGS. 22 to 26, the conveyor belt is stopped and the end 21 of the thin tube 20 of the straw 25 faces the groove 66 of the accessory-carrier 60, which is present but not shown in FIGS. 22 to 26, whereas the end 22 is disposed facing the aspiration nozzle 27 connected to a vacuum source 29 as shown in FIG. 22.

The respective carriages (not shown) on which the aspiration nozzle 27 and the accessory 1 are mounted are mobile in translation transversely to the conveyor belt, i.e. in the direction of the straw 25. They perform to-and-fro movements between a retracted position and a working position. The accessory 1 is placed in the accessory-carrier 60 whereas the carriage that carries it is in a retracted position.

Figure 25:
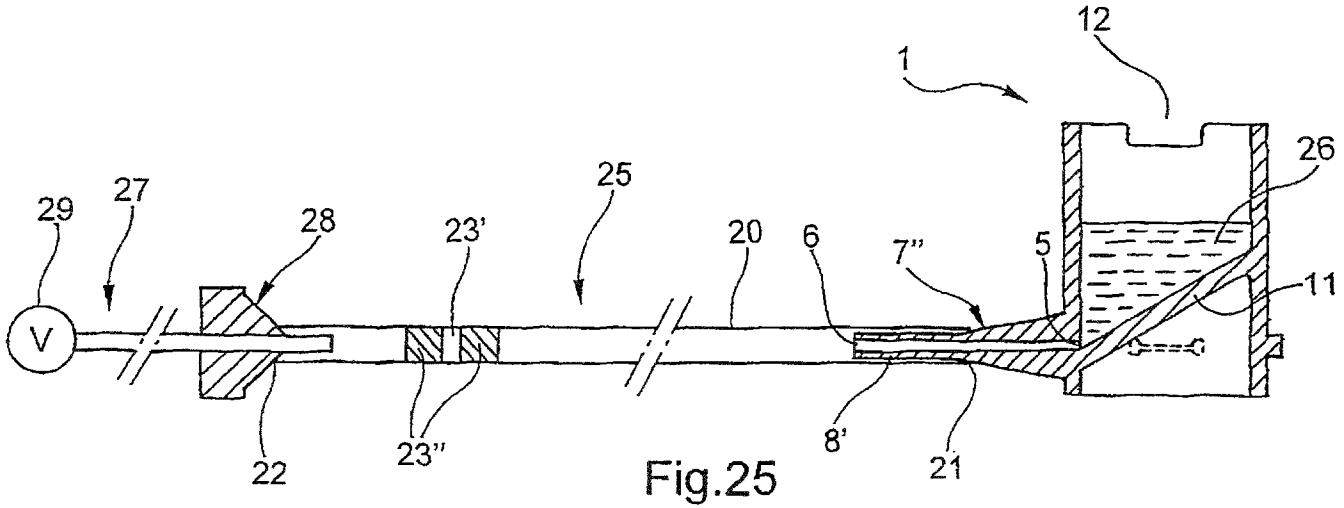
FIG. 25 is a view similar to FIG. 22 but in a position in which the accessory and the aspiration nozzle are engaged in a sealed nesting manner in the tube of the straw.

When the carriages move from their retracted position to their working position, they advance toward the straw 25 and the spout 2 and the nozzle 27 each penetrate into the tube 20. In the working position, the surface 7" of the spout 2 projecting relative to the lugs 62 (FIGS. 16 and 17) is engaged in sealed nesting fashion in the end 21 of the tube 20 and the surface 28 of the aspiration nozzle 27 is engaged in the end 22, as shown in FIG. 25.

The flexible nature of the plastic material forming the tube 20 provides a good seal with the spout 2 even if it is made from rigid plastic material. The sealing plane of the mold for the accessory 1 is here disposed away from the wall 711 so as not to interfere with the sealed cooperation of the straw 25 with the frustoconical surface 7".

The vacuum source 29 then generates in the straw 25 a reduced pressure causing a predetermined dose 26' of liquid substance to flow from the reservoir of the accessory 1 to the tube 20 via the capillary passage 4.

Note that the liquid substance passing through the accessory 1 penetrates into it through the entry opening 12 and leaves it through the outlet orifice 6.

The inclined bottom wall 11 facilitates the flow of the fluid and prevents or in any event limits phenomena of turbulence caused by too sudden changes of direction.

The composite stopper 23 of the straw 25 remains permeable to air as long as the powder 23' included between the two porous plugs 23" has not turned into a gel through contact with an aqueous liquid, in this instance the biological liquid substance to be packed.

At the end of the filling step (FIGS. 25 and 26), the composite plug 23 is therefore impermeable.

The carriages are then driven toward the retracted position and the filled straw is therefore released from the spout 2 and the nozzle 27.

The residual liquid substance 2611 contained in the reservoir after filling the straw does not flow through the capillary passage 4 for the same reasons as previously explained.

The belt is then advanced to place a new straw 25 to be filled in the filling position and to place the filled straw in position for welding its ends.

The same filling step is reproduced for each straw.

As a function of the quantity of liquid delivered into the body 3 of the accessory 1 and the quantity of liquid to be packed in the straw 25, each accessory 1 can fill one or more straws 25. The accessory can equally be filled one or more times by the robot arm 95.

On changing from one liquid substance to another, to prevent the risk of contamination, the elements that have been in contact with the previous liquid substance are replaced: in this instance the pipette tip 24 and the accessory 1.

Replacing the pipette tip 24 is well known and is usually effected by ejecting the spent tip 24 from the pipette rod 96 over a container for storing used consumables and by nesting the male connection element of the pipette rod 96 of the robot arm 95 in a new pipette tip 24 disposed in the tip-carrier.

To replace the spent accessory 1, the accessory 1 is grasped by the robot arm 95 fitted with the clamp 30 after the presser member has been retracted to return to the position that it occupied when the accessory was in the deposition position.

The clamp 30 carrying the accessory 1 is directed toward the disengagement device in order to place the rod 90 between the central body 31 of the clamp 30 and the accessory 1, on either side of the sections 36 (FIGS. 20 and 21).

During raising of the robot arm 95, the rod 90 comes to press against the body 3 of the accessory 1 which is therefore detached from the clamp 30 and drops into the container for storing spent consumables.

The clamp 30 is then available for grasping a new accessory 1 in the accessory rack.

A standard robot arm, for example of the TECAN brand, is suitable for the arm 95.

Figure 27:
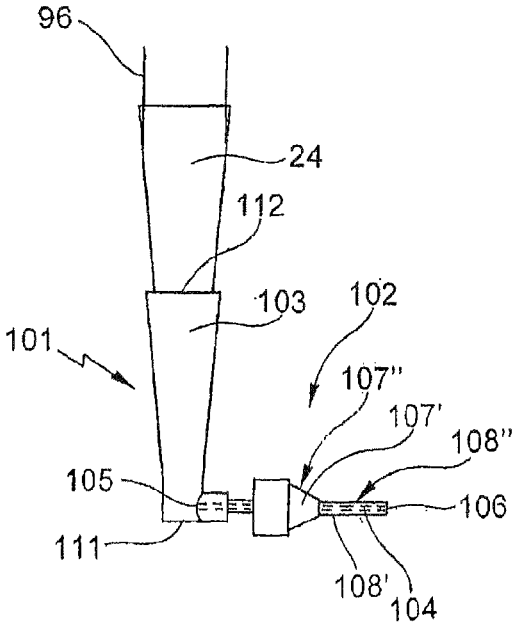
FIGS. 27 and 28 are two views in elevation of two other embodiments of the accessory in which a pipette tip is nestingly received.

In another embodiment shown in FIG. 27, the accessory 101 includes a body 103 having a frustoconical wall and a spout 102 projecting transversely to the body 103. The body 103 extends between an entry opening 112 and a bottom wall 111.

The spout 102 includes a cylindrical portion 108', one end of which is connected to the body 103 by nesting it therein, and a portion 107' attached to the cylindrical portion 108' and having a frustoconical surface 107". A capillary passage 104 in the cylindrical portion 108' extends from an outlet orifice 106 to a passage 105 through which the capillary passage 104 communicates with the space delimited by the body 103.

Figure 28:
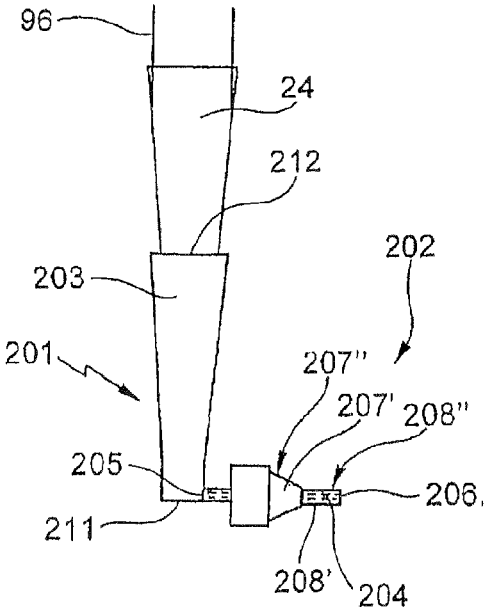

In another embodiment shown in FIG. 28, the accessory 201 is similar to the accessory 101 except that the spout 202 of the accessory 201 is formed in one piece with the body 23 also having a frustoconical wall.

The accessories 101 and 201 are used like the accessory 1 except that they cooperate with the pipette tip 24 by virtue of being mechanically connected thereto since it is received nesting fashion in the frustoconical portion of the body 103 or 203 through the entry opening 112 or 212.

These two embodiments manipulate the accessory without using a dedicated clamp or engage the spout 102 or 202 of the thin tube of a straw without using either a presser member or an accessory-carrier, since in the present case the accessory can be manipulated entirely by the robot arm 95 through the intermediary of the pipette tip 24 in which it is nested.

In a variant that is not shown, the filling accessory 101 or 201 is provided, like the accessory 1, with diverse elements enabling cooperation with a clamp such as the clamp 30, in this instance a rib like the rib 13, tongues and lugs like the tongues and lugs 14 and 15, and notches like the notch 16.

In a variant that is not shown, the filling accessory 101 or 201 is provided, like the accessory 1, with a spout like the spout 2 including a cylindrical portion and a frustoconical portion like the portions 8' and 7'.

In another variant that is not shown, the filling accessory 1 is provided, like the accessory 101 with a spout like the spout 102 including a cylindrical portion like the portion 108' to which is attached a frustoconical portion like the portion 107'.

In further variants, the bottom wall 11 of the accessory 1 can be inclined relative to the spout 2 at an angle between 25° and 35°.

In other variants the bottom wall 11' of the accessory 1' can be inclined to the spout 2 at an angle between 2.5° and 6.5°.

In further variants that are not shown, the passage that the spout of the accessory includes is not a capillary passage over the whole of the length of the spout, but only over a portion situated in the vicinity of the outlet orifice, to prevent spontaneous flow of the liquid through the spout.

The present invention is not limited to the embodiments described and shown but encompasses any variant execution.

The invention claimed is:

1. Method for packing in a straw (25) a predetermined dose (26') of a liquid substance initially contained in a receptacle (45) open at the top, including a filling step for causing said predetermined dose (26') to penetrate into said straw (25), which is lying down, with a filling accessory (1; 1'; 101; 201) nested in said straw, which method comprises, before the filling step:

the step of causing an upright pipette tip (24) to cooperate with said receptacle (45) to take up therefrom at least one dose (26') of liquid substance;

the step of procuring said accessory having a body (3; 103; 203) configured to cooperate with said upright pipette tip (24) and having a spout (2; 102; 202) with a capillary passage (4; 104; 204) configured to be nested in said straw (25), which spout is oriented transversely to said body (3; 103; 203) so that when said body (3; 103; 203) is upright said spout (2; 102; 202) is lying down; and the step of causing said upright pipette tip (24) containing at least said dose (26'), to cooperate with said body (3; 103; 203) so that the content of said pipette tip (26) belongs to said accessory (1; 1'; 101; 201)

wherein the following steps are executed automatically:

the step of causing said pipette tip (24), in the upright position, to cooperate with said receptacle (45) to take up therefrom said dose (26') of liquid substance; and the step of causing said pipette tip (24), in the upright position, containing at least said dose (26') to cooperate with said accessory (1; 1'; 101; 201) so that the content of said pipette tip (26) belongs to that accessory.

2. Method according to claim 1, further comprising, before the filling step:

the step of placing the accessory (1; 1') in an accessory-carrier (60) belonging to a mobile carriage (70) when the mobile carriage is in a retracted position; and the step of moving the carriage (70) from said retracted position to a working position in which said accessory (1; 1') is nested in a sealed manner in said straw (25).

3. Method according to claim 1, further comprising, before the step of causing said pipette tip (24) to cooperate with said receptacle (45):

the step of nesting said pipette tip (24) in a pipette (95);

while the step of causing said pipette tip (24) to cooperate with said receptacle (45) includes:

the step of disposing said pipette (95) fitted with said pipette tip (24) over said receptacle (45);

the step of immersing the end of said pipette tip (24) in said liquid substance contained in said receptacle (45); and the step of creating a reduced pressure in said pipette tip (24) to aspirate said liquid substance.

4. Method according to claim 1, wherein the step of causing said pipette tip (24) containing at least said dose (26') to cooperate with said accessory (1; 1'; 101; 201) includes:

the step of disposing said pipette tip (24) containing at least said dose (26') over said accessory (1; 1'; 101; 201); and the step of eliminating the reduced pressure in said pipette tip (24) to release the content of said pipette tip (24).

5. Method according to claim 1, further comprising, before said steps executed automatically:

the manual step of placing an accessory box including said accessory (1; 1'; 101; 201);

the manual step of placing a receptacle-carrier (46) containing said receptacle (45); and the manual step of placing a tip-carrier containing said pipette tip (24).

6. Method according to claim 5, wherein an accessory rack is selected as the accessory box.

7. Method according to claim 5, wherein a pipette tip rack is selected as the tip-carrier.

8. Method according to claim 5, wherein a receptacle rack is selected as the receptacle-carrier (46).

9. Method according to claim 5, wherein a receptacle carousel is selected as the receptacle-carrier (46).

10. Method according to claim 1, for packing in a straw (25) a predetermined dose (26') of liquid substance initially contained in a receptacle (45) open at the top, including a filling step for causing said predetermined dose (26') to penetrate into said straw (25), disposed in a lying down position, with a filling accessory (1; 1'; 101; 201) nested in said straw, which accessory is initially disposed in an accessory box, said method further comprises, before the filling step:

the step of moving said accessory (1; 1') from said accessory box to a position over an accessory carrier (60);

the step of engaging said accessory (1; 1') in said accessory-carrier (60) from above to deposit said accessory (1; 1'); and the step of causing said accessory (1; 1') to slide horizontally relative to said accessory-carrier (60) from a position deposited on said accessory-carrier (60) to a position abutting against said accessory-carrier (60).

11. Method according to claim 10, wherein the step of moving said accessory (1; 1') includes:

the step of procuring a clamp (30);

the step of said clamp (30) grasping said accessory (1; 1') in said accessory box; and the step of disposing said clamp (30) grasping said accessory (1; 1') over said accessory-carrier (60).

12. Method according to either of claim 10 or 11, wherein the step of sliding said accessory (1; 1') includes the step of moving a plunger (50) pressed against said accessory (1; 1').

13. Device for packing in a straw (25) a predetermined dose (26') of a liquid substance initially contained in a receptacle (45) open at the top, comprising an accessory (1; 1'; 101; 201) configured to be nested in the straw (25) when the straw is lying down to introduce into the straw a predetermined dose (26') of liquid substance initially contained in the receptacle (45), and a moving device for moving the accessory (1; 101; 201) so as to nest the spout (2; 102; 202) in the thin tube of the straw for nesting the accessory in the straw, said accessory having a body (3; 103; 203) configured to cooperate with an upright pipette tip (24) so that the content of said pipette tip (24) belongs to that accessory (1; 1'; 101; 201) by being collected in the body (3; 103; 203), a spout (2; 102; 202) projecting from the body (3; 103; 203) and having a capillary passage (4; 104; 204) inside the spout, the spout being configured to be nested in said straw, oriented transversely to said body so that when said body is upright said spout (2; 102; 202) is lying down, and a robot arm (95) for automatically executing the steps of causing said pipette tip (24), in the upright position, to cooperate with said receptacle (45) to take up therefrom said dose (26') of liquid substance; and causing said pipette tip (24), in the upright position, containing at least said dose (26') to cooperate with said accessory (1; 1'; 101; 201) so that the content of said pipette tip (26) belongs to that accessory.

14. Device according to claim 13, wherein said body (3; 103; 203) includes a bottom wall (11; 11'; 111; 211).

15. Device according to claim 14, wherein said bottom wall (11) is inclined relative to said spout (2) at an angle between 25° and 35°.

16. Device according to claim 14, wherein said bottom wall (11') is inclined relative to said spout (2) at an angle between 2.5° and 6.5°.

17. Device according to claim 13, wherein said spout (3; 103; 203) includes said capillary passage (4; 104; 204) throughout its length.

18. Device according to claim 17, wherein said body (3; 103; 203) includes a bottom wall (11; 11'; 111; 211) and said capillary passage (2; 102; 202) extends from an outlet orifice (6; 106; 206) to a passage (5; 105; 205) that communicates with a space delimited by said body (3; 103; 203) and said bottom wall (11; 11'; 111; 211).

19. Device according to claim 18, wherein the bottom part of said passage (5; 105; 205) is flush with the lowest part of said bottom wall (11; 11'; 111'; 211) of said body (3; 103; 203).

20. Device according to any claim 13, wherein said spout (3) includes a cylindrical portion (8') and a frustoconical portion (7').

21. Device according to claim 13, wherein said spout (103; 203) includes a cylindrical portion (108'; 208') and a frustoconical portion (107'; 207') attached to said cylindrical portion (108', 208').

22. Device according to claim 13, wherein said body (3) includes a bottom wall (11; 11') and a tubular wall divided into a first tubular portion (9) and a second tubular portion (10) by said bottom wall (11; 11').

23. Device according to claim 22, wherein said first tubular portion (9) and said bottom wall (11, 11') delimit a reservoir for containing said liquid substance while said second tubular portion (10) forms a base on which said accessory (1; 1') bears.

24. Device according to claim 13, wherein said body (103; 203) includes a bottom wall (111; 211) and a frustoconical wall extending from an entry opening (112; 212) as far as said bottom wall (111; 211).

25. Device according to claim 13, wherein said accessory (1; 1') has a rib (13) opposite said spout (2).

26. Device according to claim 13, wherein said accessory (1; 1') has two tongues (14) opposite each other on said body (3).

27. Device according to claim 26, wherein said accessory (1; 1') includes two lugs (15) one on each side of each of said tongues (14).

28. Device according to either of claim 26 or 27, wherein said accessory (1; 1') includes two notches (16) flanking an entry opening (12) above said tongues (14).

29. Device according to claim 13, further comprising a clamp (30) having a central body (31) and two elastically deformable arms (34) connected to said central body (31) including a hook (37) in a distal part of the arms (34) configured to be engaged with or disengaged from said respective tongue (14) of said accessory (1; 1') by elastic deformation of said arms (34).

30. Device according to claim 29, wherein said arms (34) include a section (36) disposed between said central body (31) and said hook (37).

31. Device according to claim 29, wherein said hook (37) has a convex surface (38) against which said tongue (14) bears to load said arms (34) elastically.

32. Device according to claim 30, wherein said accessory (1; 1') includes two notches (16) flanking an entry opening (12) and each arm (34) has, at the junction between said section (36) and said hook (37), a shoulder (42) configured to be housed in said respective notch (16) of said accessory (1; 1') when said hooks (37) are engaged in said tongues (14).

33. Device according to claim 13, further comprising an accessory-carrier (60) including a base (61) on which said accessory (1; 1') bears when said accessory rests on said accessory-carrier (60) and lugs (62) against which said accessory (1; 1') abuts when said accessory (1; 1') is in abutment position, said spout (2; 102; 202) projecting beyond said lugs (62).

34. Device according to claim 33, wherein said lugs (62) have a circular-arc-shaped depression (67) against which said accessory (1; 1') abuts in said abutment position.

35. Device according to claim 33, wherein said lugs (62) are separated by a frustoconical profile groove (66) in which said accessory (1; 1') is accommodated.

36. Device according to claim 35, wherein said accessory (1; 1') has two tongues (14) opposite each other on said body (3) and two lugs (15) one on each side of each of said tongues (14) and in that said lugs (62) of said accessory-carrier (60) have on the side opposite said frustoconical groove (66) a projecting rim (68) under which one of said lugs (15) of said accessory (1; 1') locates when said accessory (1; 1') is in said abutment position.

37. Device according to claim 13, further comprising a plunger (50) including a presser member (53) and an actuator including a rod (51) and a body (52), said presser member (53) being configured to bear against said accessory (1; 1') so that the accessory slides from a first position to a second position.

38. Device according to claim 37, wherein said presser member has a circular-arc-shaped depression (54) configured to come into contact with said accessory (1; 1').

39. Device according to claim 37, wherein said accessory (1; 1') has a rib (13) opposite said spout (2) and said presser member (53) and said rib (13) are arranged so that said rib (13) locates under the lower surface (55) of said presser member (53) when said presser member (53) comes into contact with said accessory (1; 1').

40. Device for packing in a straw (25) a predetermined dose (26') of a liquid substance initially contained in a receptacle (45) open at the top, comprising an accessory (1; 1') configured to be moved so as to be nested in a straw (25) in a lying down position to introduce into the straw a predetermined dose (26') of liquid substance initially contained in a receptacle (45) open at the top, and a moving device for moving the accessory (1; 101; 201) so as to nest the spout (2; 102; 202) in the thin tube of the straw for nesting the accessory in the straw, wherein said accessory has a body (3; 103; 203) configured to cooperate with an upright pipette tip (24) so that the content of said pipette tip (24) belongs to that accessory (1; 1'; 101; 201) by being collected in the body (3; 103; 203), a spout (2; 102; 202) projecting from the body (3; 103; 203) and having a capillary passage (4; 104; 204) inside the spout, the spout being formed in a single rigid block configured to be nested in said straw (25), and a robot arm (95) for automatically executing the steps of causing a pipette tip (24), in the upright position, to cooperate with said receptacle (45) to take up therefrom said dose (26') of liquid substance; and causing said pipette tip (24), in the upright position, containing at least said dose (26') to cooperate with said accessory (1; 1'; 101; 201) so that the content of said pipette tip (26) belongs to that accessory.

41. Device according to claim 40, wherein said spout (2) includes a frustoconical portion (7') and a cylindrical portion (8').

42. Device according to claim 40, wherein said spout (2) includes a capillary passage (4).

43. Device according to claim 40, wherein said spout (2) is molded in one piece from rigid plastic material.

* * * * *